United States Patent [19]

McNair

[11] Patent Number: 4,564,188

[45] Date of Patent: Jan. 14, 1986

[54] SINGLE SHEET FEEDING MECHANISM

[75] Inventor: John R. McNair, Scarsdale, N.Y.

[73] Assignee: Westvaco Corporation, New York, N.Y.

[21] Appl. No.: 671,009

[22] Filed: Nov. 13, 1984

[51] Int. Cl.[4] ..... B65H 3/08

[52] U.S. Cl. ..... 271/103; 271/106; 271/107; 294/64.1; 414/330

[58] Field of Search ..... 271/90, 91, 94, 100, 271/103, 104, 105, 106, 107; 414/181, 330, 737, 744 B, 752; 294/64.1; 198/689

[56] References Cited

U.S. PATENT DOCUMENTS

| | | | |
|---|---|---|---|
| 783,206 | 2/1905 | Juengst | 271/106 |
| 1,252,280 | 1/1918 | McDonald | 294/64.1 |
| 1,990,334 | 2/1935 | Koppe | 271/103 |
| 2,163,274 | 6/1939 | Dixon | 271/106 |
| 2,382,405 | 8/1945 | Eckman | 271/106 |
| 2,745,665 | 5/1956 | Lambombarde | 271/106 |
| 3,322,301 | 5/1967 | Bliss | 271/106 |
| 3,994,488 | 11/1976 | Takenaka et al. | 271/106 |
| 4,420,150 | 12/1983 | Umezawa | 271/106 |
| 4,428,793 | 1/1984 | Sato et al. | 271/106 |

FOREIGN PATENT DOCUMENTS

| | | | |
|---|---|---|---|
| 0115871 | 9/1979 | Japan | 271/104 |

*Primary Examiner*—Bruce H. Stoner, Jr.
*Assistant Examiner*—John A. Carroll
*Attorney, Agent, or Firm*—W. A. Marcontell; R. L. Schmalz

[57] ABSTRACT

Single sheet feed reliability for suction cup mechanisms handling highly permeable paper sheet is improved with a quickly and conveniently attached rigid cup enclosure of an extensible bellows cup. An internal thread is provided in the suction pipe ends for receipt of an externally threaded T-nut shank. The T-nut secures both, the rigid cup enclosure and the extensible bellows.

1 Claim, 4 Drawing Figures

SINGLE SHEET FEEDING MECHANISM

BACKGROUND OF THE INVENTION

1. Field of the Invention

The present invention relates to paper sheet handling machinery for separating a single paper sheet from a magazine stack. Selectively actuated vacuum applied to suction cups that are secured to an articulated arm are the general mechanism to which the present invention applies.

2. Description of the Prior Art

Numerous paper sheet converting operations require a transitional feed step which entails removal of a single sheet from a magazine stack of sheets, the single sheet being placed in a serial flow production line.

One successful method of accomplishing this transitional step, mechanically, has been to grasp the single, face sheet of the magazine with suction cups secured to an articulated arm mechanism. As the cyclic movement of the arm mechanism positions the suction cups against the magazine face sheet, the cup interiors are selectively opened to a vacuum source. Secure to the suction cups, the arm continues its cycle to draw the single sheet away from the magazine and position it on the serial flow line. Synchronized release of the vacuum releases the sheet from the suction cups.

Although simple in principle and mechanical operation, the subject transitional step can be capricious and unreliable due to a characteristic trait of drawing more than one sheet from the magazine stack. This undesirable trait is normally caused by the air permeability of the sheet. Curiously, the same multiple sheet pick-up malfunction may be triggered by sheet permeability characteristics of opposite extremes. For a highly permeable sheet the powered vacuum at the cups projects through the face sheet and against the second or even third sheet behind the face sheet. In the case of impermeable sheets, resistance to atmospheric penetration through the sheet creates a vacuum behind the face sheet when an attempt is made to draw the face sheet normally from the stack.

Generally, the corrective technique for these symptomatically similar but physically different malfunctions is the same. By one of several devices, the face sheet is required by the suction cups or arm movement to slide into a shorter radius curve or pucker than the second sheet thereby breaking the vacuum between the first and second sheets.

Numerous U.S. patents have issued for mechanical devices of this sort. Representative is U.S. Pat. No. 2,745,665 issued May 15, 1956 to H. S. Labombarde which discloses rigid ring structure around a bellows extensible suction cup to increase gripping forces on the cup attached sheet.

Another reference of similar disclosure is that of U.S. Pat. No. 2,163,274 issued May 29, 1937 to J. F. Dixon.

While it is presumed that these prior art devices are operative for the purpose disclosed, such devices are cumbersome for attachment to or removal from the basic, suction cup arm structure. When the sheet feeder always handles the same paper of exactly the same mechanical characteristics and properties e.g. caliper, basis weight, permeability and stiffness, ease of accessory attachment and removal is of little consequence. However, use of identical sheet properties may be somewhat limiting as to supply sources and productivity.

Paper is a unique material in that the mechanical properties of a particular sheet are intimately related to the machine upon which the paper was laid. Although two sheets from different machines may appear identical as to caliper and surface texture, great differences may exist as to basis weight, permeability and stiffness. A highly calendered sheet may have greater basis weight, less porosity but only slightly greater stiffness for a given caliper thickness.

To the article packaging industry, this scope of paper properties can be both harmful and helpful. If the primary package criteria are caliper, stiffness and printability, a wide range of sources may be available for supply reliability and competitive pricing. However, paper is generally valued by weight. Therefore, higher basis weight paper is more expensive per unit area than lower basis weight material.

For the dominate reasons of supply reliability and continuity, many packaging converters choose to procure their paper from several sources, slight price differentials notwithstanding. Resultantly, the converting machines must be conveniently adjustable to accommodate a running mixture of paper properties.

It is therefore, an objective of this invention to provide a suction feed accessory for quickly and conveniently adjusting the permeability responsiveness of the machine.

Another object of the invention is to provide a permeability adjustment accessory for sheet feeders that requires no subframe or other permanent mounting structure.

SUMMARY OF THE INVENTION

These and other objects of the invention are accomplished by means of sheet surface distorting device comprising a rigid cup enclosure for an extensible bellows cup. Both, rigid cup and bellows are secured to the vacuum piping structure by a single, axially located T-nut. Being an accessory to the suction head assembly, the rigid cup is secured to the piping by the same fastener arrangement as the bellows but is independently separable. No external or additional fastener structure is required for the rigid cup.

DESCRIPTION OF THE DRAWINGS

Relative to the drawings wherein like reference characters designate like or similar elements throughout the several figures.

DESCRIPTION OF THE PREFERRED EMBODIMENTS

Figure 1:
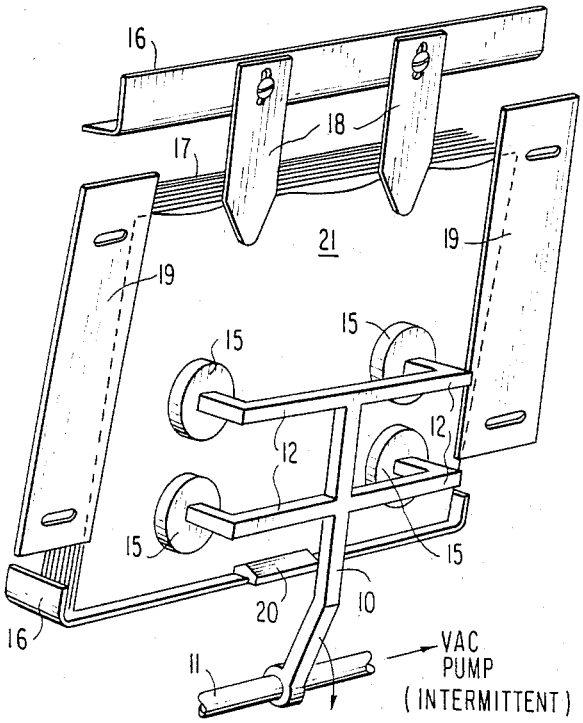
FIG. 1 is a pictorial view of a suction cup sheet feeding mechanism equipped with the circumvallating rings of the present invention.
Figure 2:
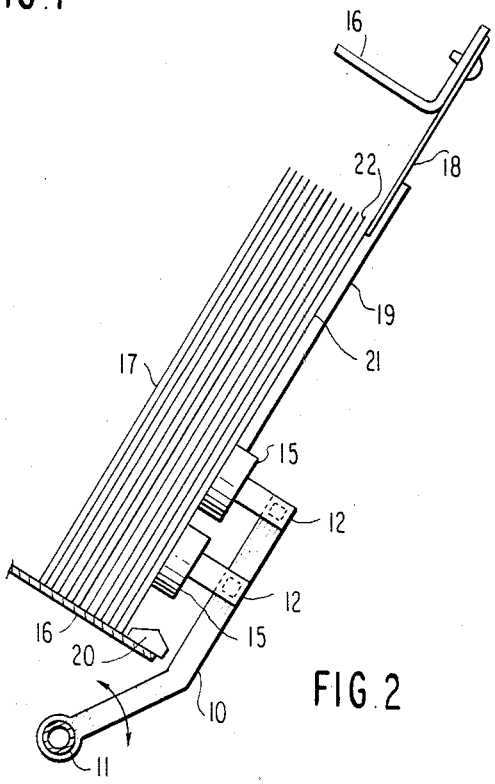
FIG. 2 is an end view of the mechanism illustrated by FIG. 1.

A sheet feeder mechanism of a paper converting machine is generally represented by FIGS. 1 and 2 which illustrates an oscillating arm 10 secured to an evacuated bore drive shaft 11. The outer end of arm 10 may include one or more mounting fingers 12, four in this case, to which suction heads, shown generally as elements 15, are secured. Internally, the fingers 12 and arm 10 are hollow to pneumatically communicate the suction heads 15 with the evalcuated bore of drive shaft 11. The drive shaft bore is connected with a vacuum pump or other evacuation means.

The sheet feeder mechanism functions cooperatively with a sheet magazine 16 which holds a stack of sheeted paper 17 by confinement tabs 18, 19 and 20. These tabs share a common plane for definition of the leading sheet plane from where the first sheet 21 is removed to be repositioned by the suction heads 15.

In operation, the drive shaft 11 is twisted to rotate the arm 10 into a position at which the suction heads 15 engage the surface of magazine face sheet 21. In timed coordination with engagement of the face sheet, the suction heads 15 are evacuated to grasp the face sheet by atmospheric pressure differential. So secured, the drive shaft 11 is twisted in an opposite direction to draw the face sheet 21 out of the magazine tab plane. The face sheet is now separated from the magazine stack 17 as a single sheet. As the shaft 11 and arm 10 continue rotation, the single sheet is moved into a different plane which may be that of a line conveyor not shown. Upon arrival at the desired position for the single sheet, the vacuum within the suction heads 15 is relieved and the sheet released.

As related previously, reliability of the aforedescribed operation is highly dependent on the sheet permeability characteristics. Highly permeable paper may transmit a significant vacuum gradient from a suction head through two or more sheets in the magazine. Consequently, the feeder mechanism will withdraw two or more sheets from the stack feeding face.

An impermeable sheet may respond to the feed mechanism in a similar manner due to vacuum pressures between the face sheet 21 and the next sheet 22 into the stack which hold the two sheets together as the first is withdrawn.

Figure 3:
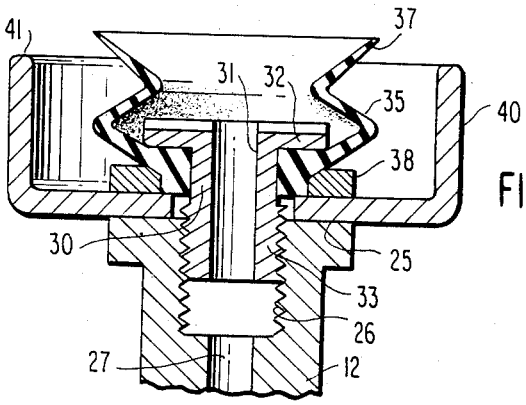
FIG. 3 is a sectional elevation of a suction head pursuant to the invention; and, FIG. 4 is a sectional elevation of the invention in operative combination with a sheet magazine.
Figure 4:
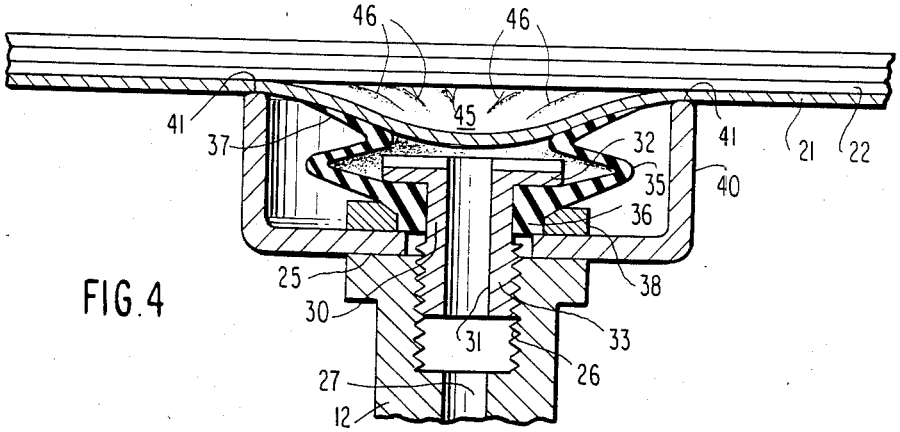

Responsive to these diverse conditions, the present invention suction head illustrated by FIGS. 3 and 4 comprises a flat shoulder area 25 at the distal tip of finger 12 around an internally threaded bore 26. This threaded bore is located in coaxial alignment with the finger piping conduit 27 to coaxially align the bore 31 within a threaded shank T-nut 30. The T-nut head flare 32 serves to compress the base section 36 of a convoluted elastomer bellows 35 into sealing engagement between the shank 33 and a confinement ring 38. Secured between the confinement ring and the sealing face of shoulder 25 is the transverse bottom or base section of a rigid, circumvallating cup 40 having a cylindrical wall portion 41. This cylindrical wall 41 is dimensioned to engage a stack face sheet 21 at the rim thereof after the bellows lip 37 whereby the primary vacuum zone against the face sheet 21 is within the open mouth perimeter of the fully extended bellows lip 37.

By the foregoing assembly combination, the suction head 15 may be operated with or without the circumvallating cup 40 depending on the permeability characteristics of the paper in the magazine 16.

FIG. 4 specifically illustrates operation of the suction head with the circumvallating cup in place. As the suction head approaches the paper stack face sheet 21 normally, bellows lip 37 make initial contact to seal off an evacuated zone therewithin. Such vacuum zone draws a sperically domed or bubble portion 45 of the face sheet 21 inwardly toward the T-nut head 32 and below the level of the cup rim. However, paper is a relatively tough material having a high yield strength and does not stretch to accommodate the spherical shape demanded by the forces applied. Accordingly, radial pleats and wrinkles 46 in the sheet 21 emanate from the dome beyond the cup rim. These pleats and wrinkles serve as air flow channels to induce an air boundary layer and to break the vacuum gradient transfer between the face sheet 21 and the second sheet 22. Hence, resistance to normal removal of the face sheet 21 from the stack is greatly reduced.

Having fully disclosed my invention, I claim:

1. A suction head for a paper sheet feeder mechanism comprising rigid piping means secured to articulated arm means, axial aperture means through said piping means in fluid communication with vacuum pumping means for drawing atmospheric air through said aperture means comprising internally, threaded bore means disposed at the distal end of said piping means, rigid sealing face means terminating said piping means around said bore means, T-nut means having a flared compression surface of one end of an externally threaded shank for turning into said threaded bore means, rigid cup means having a cylindrical wall terminated at one axial end by a transverse bottom wall, said bottom wall having an axial aperture therethrough for receiving the shank of said T-nut means, an annular segment of said bottom wall means around said axial aperture finished to sealably engage said piping means sealing face, elastomer bellows means having convolutes axially disposed between an open mouth portion and an axially apertured base portion, said convolutes having an external diameter less than said rigid cup wall, said base portion aperture sized to axially receive therewithin and seal thereabout said T-nut shank and confinement ring means disposed externally of said bellows base portion for confining said base portion radially in a space between said confinement ring means and said cup bottom wall when said T-nut shank is turned into said threaded bore means.

* * * * *